United States Patent [19]

Landphair et al.

[11] Patent Number: 4,539,246

[45] Date of Patent: Sep. 3, 1985

[54] SOCKET CASTING WITH A CAST-IN BALL AND METHOD OF CASTING

[75] Inventors: Donald K. Landphair, Bettendorf, Iowa; James P. Doering, Moline, Ill.

[73] Assignee: Deere & Company, Moline, Ill.

[21] Appl. No.: 592,522

[22] Filed: Mar. 23, 1984

[51] Int. Cl.[3] ..... B22B 3/10; B32D 19/00

[52] U.S. Cl. ..... 428/131; 164/9; 164/11; 164/98

[58] Field of Search ..... 428/131; 164/9, 10, 164/11, 98, 99, 112

[56] References Cited

U.S. PATENT DOCUMENTS 1,050,370 1/1913 McGlashan et al. ..... 164/11

3,426,832 2/1969 Phillips et al. ..... 164/11

3,437,307 4/1969 Atwater ..... 164/98

OTHER PUBLICATIONS

Deere & Co., Part Drawing AE-36262, (Production Date 1977).

*Primary Examiner*—W. D. Bray

*Attorney, Agent, or Firm*—Henderson & Sturm

[57] ABSTRACT

A method of forming a socket with a cast-in spherical ball having a central opening formed therethrough. The method includes preparation of a core assembly to incorporate the ball such that a portion of the circumference of the ball surface defines a portion of the casting cavity forming a race surface for the ball.

18 Claims, 5 Drawing Figures

SOCKET CASTING WITH A CAST-IN BALL AND METHOD OF CASTING

TECHNICAL FIELD

This invention relates to casting processes and more particularly to a casting process and products produced by the process having a cast-in movable element.

BACKGROUND ART

Casting processes use a wide variety of materials which, when in a molten state, can be charged into a flask or mold to produce a part of a desired configuration.

Ferrous castings are used for a wide variety of applications throughout the manufacturing industry. The most common of the ferrous casting materials is gray iron which has graphite dispersed in flake form. It is readily produced at a low cost and displays good strength and excellent machinability for wide usage. Ductile iron, or nodular iron, contains graphite in spherical rather than flake form. Ductile iron exhibits high tensile strength, ductility and resistance to shock.

In general, ferrous castings are formed in a flask or mold having a top half called the cope and a bottom half called the drag. The flask is placed over a part pattern and filled with slightly moist, compactible sand, known as green sand. The flask is then jolted to settle the sand and a high pressure hydraulic press compacts it until it is firmly packed and uniformly hard. The part pattern is then removed, leaving an impression in the sand which forms the outside features of the part.

Inside features of a part are formed by the placement of core assemblies in the mold at the desired locations. Cores are specially shaped pieces of hard-cured sand formed in a separate mold called a core box. The shape of the core is defined by the inside cavity of the core box as modified by the selective placement of loose pieces within the core box.

After the core assemblies are placed in the mold, the cope and drag are placed together forming a mold joint called a parting line. Upon closing, the mold is ready to receive the molten iron. After pouring, the cast part is cooled and removed from the mold for finishing.

It is sometimes desirable to incorporate a separate functionally movable element within the cast part. Such 'cast-in' elements generally reduce the number of manufacturing and assembly steps required to produce a functional subassembly. Cast-in parts can be made of material either like or unlike the material used to form the cast portion. When like materials are used, the cast-in part can be coated with silica sand to prevent bonding between the cast-in part and the casting. When dissimilar materials are used, coating may not be required since shrinkage of the cast portion upon cooling can provide adequate clearance to allow movement of the cast-in part.

Although rotatable rollers and enlarged ends of rotatable shafts have been cast-in metal castings, heretofore, a spherical ball having a central opening therethrough has not been cast-in an annular ring such that the ball is able to freely rotate about its center in any direction.

DISCLOSURE OF THE INVENTION

The present invention provides a method of forming a socket with a cast-in spherical ball having a central opening formed therethrough. The method includes preparation of a core assembly to incorporate the ball as a part thereof, and positioning of the core assembly within a casting mold. The casting mold with the inserted core forms a casting cavity defining an annular ring having an inside race defined by a portion of the circumference of the ball surface. The casting cavity when charged with molten material forms a cast annular ring that receives the ball for free rotation about its center.

The core assembly is prepared by magnetically holding a steel ball in position on a core box loose piece, and inserting the loose piece into the cavity of the core box such that the central opening of the ball will receive core material as the core box is packed to form a sand core. The core assembly thus prepared has an exposed section of the ball as part of the core's surface.

An object of the present invention is the provision of an improved casting process.

Another object is to provide a casting process that reduces production costs.

A further object of the invention is the provision of a casting process that is simple and efficient to use.

Still another object is to provide a casting process for forming an outer race for a freely rotatable ball.

A still further object of the present invention is the provision of a casting process that eliminates costly machining and reduces the number of manufacturing steps required to produce a part including a freely rotatable ball.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
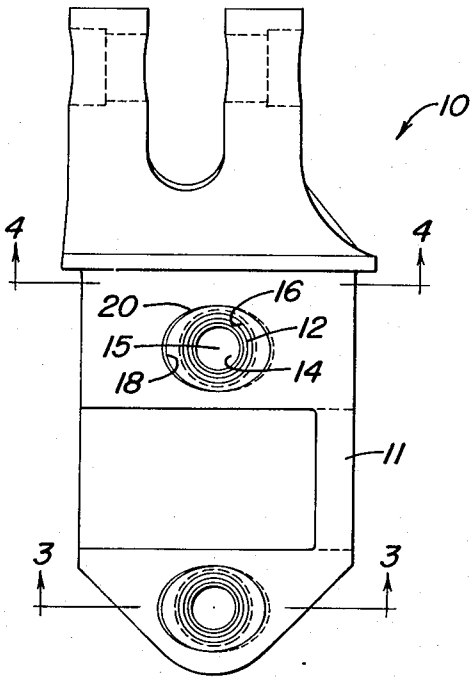
FIG. 1 is a side elevational view of a hitch member formed by the process of the present invention wherein a pair of spherical balls are cast-in a ductile iron casting such that the balls are freely rotatable about their centers.

Referring now to the drawings wherein like reference numerals designate identical or corresponding parts throughout the several views, FIG. 1 shows a hitch member (10) formed by the process of the present invention. The hitch member (10) includes a body section (11) which receives a pair of spherical balls (12) having central openings (14) formed therethrough. Each ball (12) is journalled for rotation about its center (15) by contact with an arcuate race (16).

Figure 2:
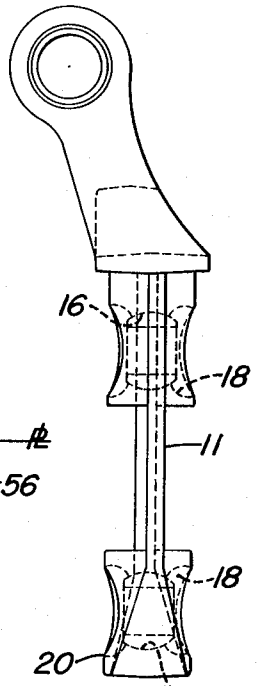
FIG. 2 is a top plan view of the hitch member shown in FIG. 1.
Figure 3:
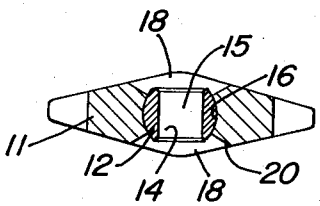
FIG. 3 is a sectional view taken along line 3—3 of FIG. 1.

As most clearly shown in FIGS. 2–3, the race (16) is disposed between two recessed cavities (18) formed on each side of the body section (11). The cavities (18) define an annular ring (20) disposed perpendicular to the axis of the central opening (14). It can be seen that the ball (12) is free to rotate about its center (15) within race (16).

Figure 5:
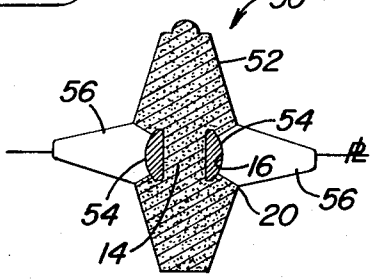
FIG. 5 is a sectional view similar to FIG. 4, and further illustrating the core assembly of the casting process.
Figure 4:
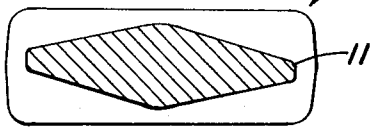
FIG. 4 is a sectional view taken along line 4—4 of FIG. 1.

The spherical balls (12) are cast-in the hitch (10) by the method of this invention. Referring now to FIG. 5, a core assembly (50) is prepared by incorporating a spherical ball (12) within the core assembly such that the hard sand core (52) extends through and fills the central opening (14). The exterior surface of the assembly (50) includes the exposed surface area (54) of the ball (12).

The core assembly (50) is prepared by holding the steel ball (12) in position on a core box loose piece (not shown) by attraction to a press-in magnetic piece (not shown) attached to the loose piece. The loose piece is then inserted into the cavity of a core box (not shown) such that the central opening (14) of the ball (12) will receive core sand material as the core box is packed to form the core assembly (50) (FIG. 5).

Once the core assembly has been prepared, the core assembly is positioned within a casting mold (illustrated generally by the parting line "PL" in FIG. 5) to form a casting cavity (56). The casting cavity (56) defines an annular ring (20) having an inside race surface (16) defined by exposed surface area (54) of ball (12).

When the core assemblies (50) have been positioned, the mold halves are closed to form a parting line PL (FIG. 5), and molten ductile iron is charged into the casting cavity (56). The casting is then cooled, removed from the mold and standard finishing operations are performed. As the casting cools, the mass of ductile iron shrinks and a spacing is provided between the race (16) and the entrapped steel ball (12) such that the ball is free to rotate about its center (15).

Although a coated steel ball (12) can be used, it has been found that no coating is necessary to prevent bonding of the liquid ductile iron to the steel ball (12) before or during solidification. The steel ball (2) is mechanically entrapped by the race (16) while remaining free to rotate in the newly formed socket. If the ball (12) is initially frozen in the race (16), it may be loosened by inserting a pry bar in the central opening (14) to apply force to free the ball (12).

The casting process described above reduces production cost by eliminating costly machining steps that would otherwise be required to form a socket for a rotating ball. Connecting members of all kinds, including the standard draft link swivel ball connections, can be manufactured by the disclosed process.

Thus, it can be seen that at least all of the stated objectives have been achieved.

Obviously, many modifications and variations of the present invention are possible in light of the above teachings. It is therefore to be understood that, within the scope of the appended claims, the invention may be practiced otherwise than as specifically described.

We claim:

1. A method of forming a socket casting with a cast-in ball having a central opening formed therethrough, said method comprising the steps of:

preparing a core assembly including a spherical ball having a central opening formed therethrough;

positioning the core assembly within a casting mold such that a casting cavity is formed, said casting cavity defining an annular ring having an inside race surface defined by the portion of the circumference of said ball surface intermediate the central opening and perpendicular to the axis of the opening; and charging molten material into the casting cavity to form said annular ring of cast material, whereby the spherical ball is rotatably attached within the annular ring such that the ball is free to rotate about its center in any direction.

2. The method of claim 1 wherein the core assembly preparation step further includes the step of forming a hard sand core to extend through and fill the central opening of the ball.

3. The method of claim 2 wherein the core assembly preparation step further includes holding said ball in position on a core box loose piece by magnetic force during said core forming step.

4. The method of claim 1 wherein said ball is constructed of steel.

5. The method of claim 4 wherein said steel ball is coated to aid in preventing bonding of the molten material to the steel ball.

6. The method of claim 1 wherein said molten material is iron.

7. The method of claim 6 wherein said molten material is gray iron.

8. The method of claim 6 wherein said molten material is ductile iron.

9. A socket casting with a cast-in ball produced by the method of claim 1.

10. A socket casting with a cast-in ball produced by the method of claim 2.

11. A socket casting with a cast-in ball produced by the method of claim 3.

12. A socket casting with a cast-in ball produced by the method of claim 4.

13. A socket casting with a cast-in ball produced by the method of claim 5.

14. A socket casting with a cast-in ball produced by the method of claim 6.

15. A socket casting with a cast-in ball produced by the method of claim 7.

16. A socket casting with a cast-in ball produced by the method of claim 8.

17. A method of forming a socket casting with a cast-in ball having a central opening formed therethrough, said method comprising the steps of:

preparing a core assembly including a ball having an opening through its center and an outer surface defining a portion of a sphere;

positioning the core assembly within a casting mold such that a casting cavity is formed, said casting cavity being in the form of an annular ring having an inside race surface formed by a portion of said outer surface; and charging molten material into the casting cavity to form said annular ring of cast material, whereby the ball is rotatably attached within the annular ring such that the ball is free to rotate about its center in any direction.

18. A socket casting with a cast-in ball produced by the method of claim 17.

* * * * *